US007891469B1

(12) United States Patent
Sipos

(10) Patent No.: US 7,891,469 B1
(45) Date of Patent: Feb. 22, 2011

(54) DISCRETE ELEMENT SPIDER

(76) Inventor: David L. Sipos, 206 Greenhaven Dr., Lafayette, LA (US) 70508

( * ) Notice: Subject to any disclaimer, the term of this patent is extended or adjusted under 35 U.S.C. 154(b) by 0 days.

(21) Appl. No.: 12/002,581

(22) Filed: Dec. 18, 2007

Related U.S. Application Data

(63) Continuation of application No. 11/070,175, filed on Mar. 1, 2005, now abandoned.

(51) Int. Cl.
*B65H 59/10* (2006.01)

(52) U.S. Cl. ..... 188/67; 175/195

(58) Field of Classification Search ..... 188/67; 166/209, 77.4, 77.51–77.53; 175/423, 162, 175/195; 173/167; 285/123.5, 123.8, 123.11
See application file for complete search history.

(56) References Cited

U.S. PATENT DOCUMENTS

| | | | | |
|---|---|---|---|---|
| 1,381,074 | A | 6/1921 | Livergood | |
| 1,849,102 | A | 3/1932 | Livergood | |
| 1,852,695 | A | 4/1932 | Carroll | |
| 1,966,454 | A | 7/1934 | Moody | |
| 2,143,615 | A | 1/1939 | Abegg | |
| 2,231,923 | A * | 2/1941 | Koen | 188/67 |
| 2,612,671 | A | 10/1952 | Martin | |
| 3,579,752 | A | 5/1971 | Brown | |
| 3,722,603 | A | 3/1973 | Brown | |
| 3,748,702 | A | 7/1973 | Brown | |
| 4,269,277 | A * | 5/1981 | Baugh | 173/149 |
| 4,306,339 | A | 12/1981 | Ward | |
| 4,332,062 | A | 6/1982 | Byrne, Jr. | |
| 4,333,209 | A * | 6/1982 | Herst | 188/67 |
| 4,681,193 | A | 7/1987 | Crowe | |
| 4,823,919 | A * | 4/1989 | Hayatdavoudi | 188/67 |
| 5,335,756 | A | 8/1994 | Penisson | |
| 5,992,801 | A | 11/1999 | Torres | |
| 6,386,284 | B1 | 5/2002 | Buck et al. | |
| 6,394,201 | B1 | 5/2002 | Feigel | |
| 6,471,439 | B2 | 10/2002 | Allamon et al. | |
| 6,557,641 | B2 | 5/2003 | Sipos et al. | |
| 6,631,792 | B2 | 10/2003 | Buck | |
| 6,820,705 | B2 * | 11/2004 | Baugh | 175/423 |
| 7,267,168 | B1 | 9/2007 | Sipos | |

OTHER PUBLICATIONS

U.S. Appl. No. 10/959,278 to David L. Sipos for Spider with Disbributed Gripping Dies. Filed Oct. 5, 2004.

* cited by examiner

*Primary Examiner*—Robert A Siconolfi
*Assistant Examiner*—Mariano Sy

(57) ABSTRACT

A rotary table has a non-circular drive recess in the central opening which carries a fitting adapter ring to which slip carriers are attached. A plurality of slip carriers are distributed about the periphery of the adapter ring and extend down into the central opening of the rotary table. A slip and die arrangement is situated on each slip carrier. Slip manipulation drive cylinders, as an option, are distributed about the adapter ring periphery and move a synchronizer ring that moves the slips vertically to grip or release pipe extending through the opening of the rotary table. The drive cylinders, as an option, may be comprised of flexible bellows.

31 Claims, 6 Drawing Sheets

DISCRETE ELEMENT SPIDER

This is a continuation application under 37 CFR 1.53(b) entitled "Discrete Element Spider". The prior application is Ser. No. 11/070,175 filed on Mar. 1, 2005 now abandoned by applicant for "Discrete Element Spider", the entire contents of which are hereby incorporated by reference. This application claims priority to prior application Ser. No. 11/070,175.

This invention relates to pipe support apparatus known in the well drilling art as spiders and elevators. Individual pipe gripping assemblies are attached to an adapter ring that is carried in a rotary table opening to comprise a spider. Some types of elevator housings can be similarly adapted.

BACKGROUND OF THE INVENTION

Drill strings are usually supported by spiders that fit in the opening of the rotary table. They usually have a slip bowl in which slips are peripherally distributed to surround pipe to be gripped. The slip bowl opens upwardly. When a pipe string suspended in the well is to be gripped by the spider, the slips are moved downward. The slip bowl surface urges the downwardly moving slips to move radially inward to bear upon, and grip, the pipe. When the slips grip pipe loads, the resulting downward force adds to the radially inward thrust of the slips, and largely defines the essential elements of what has become known as the fail safe system. Teeth carried by the slips contact the pipe to improve pipe security. The teeth may be on detachable dies that are carried by the slips.

Spiders are currently sold as an assembly which is inserted into the rotary table opening. Considerable design and engineering work has gone into the slip manipulation gear related to spiders. The spider housing, in effect, duplicates the function of the rotary table structure.

Larger tubulars, such as casing, are usually handled by spiders that rest on the rig floor above the rotary table. Such spiders are often capable of serving as elevators. The novel slip carriers and slip powering apparatus of this invention can be applied to such spider structures with minimum preparation.

Slips have to be secured to retain, or control, their peripheral distribution within the slip bowl. The slip control structure and slip manipulation gear makes up a considerable part of the usual spider. Such a composite spider can often function with minor, or no, adaptation as an elevator. In some cases, there is no way to distinguish a spider from an elevator.

Spiders and elevators, in many cases, have no power actuators and are strictly manual in operation. When composite spiders are prepared by the manufacturer for use in the field, they have limited adaptability to function for a variety of pipe sizes and, if considerable diversity of use is planned, several spiders have to be on hand or readily available. There is a need for spider sub-assemblies that can be fitted into rotary tables, or related structure, to enable adaptability not currently practical.

SUMMARY OF THE INVENTION

In the peripheral non-circular recess on the upper opening of a rotary table, a ring can be installed with non-circular surfaces to mate the recess surfaces. A plurality of slip carriers are provided for distribution peripherally about the ring and secured there to extend downwardly into the opening of the rotary table. A slip manipulation surface on each slip carrier slopes downward toward the vertical center line of the rotary table. On each slip carrier, a slip is situated for retention thereon and vertical movement relative thereto. Each slip has a vertically extending surface facing the center line and provided with pipe gripping teeth. When secured to the ring, slip manipulation gear moves the slips vertically as required to grip pipe. As a design option, slip powering linear motors can be distributed about the ring periphery and attached to the ring. The linear motors can move the slips vertically by way of synchronizing members to assure that pipe gripped is first assured a generally central position within the rotary table.

These and other objects, advantages, and features of this invention will be apparent to those skilled in the art from a consideration of this specification, including the attached claims and appended drawings.

BRIEF DESCRIPTION OF DRAWINGS

The drawings show assemblies typical of the result of using the

DETAILED DESCRIPTION OF DRAWINGS

Figure 2:
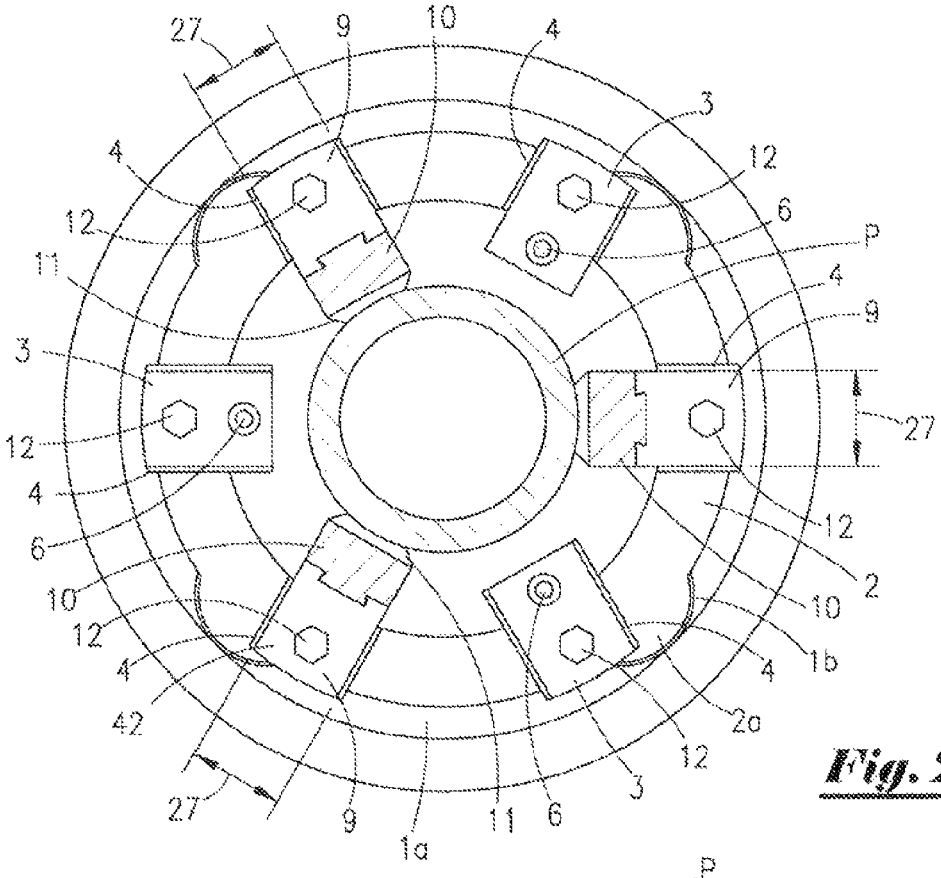
FIG. 2 is a sectional view taken along line 2-2.

In the drawings, features that are well established in the art and do not bear upon points of novelty are omitted in the interest of descriptive clarity. Such omitted features may include threaded junctures, weld lines, sealing elements, pins and brazed junctures.

The novel slip carrier assembly 40 is comprised of a plurality of, sub-assemblies 42 adapted for a spider is shown Each sub-assembly 8 is comprised of a slip carrier 9 and a slip 10.

Figure 1:
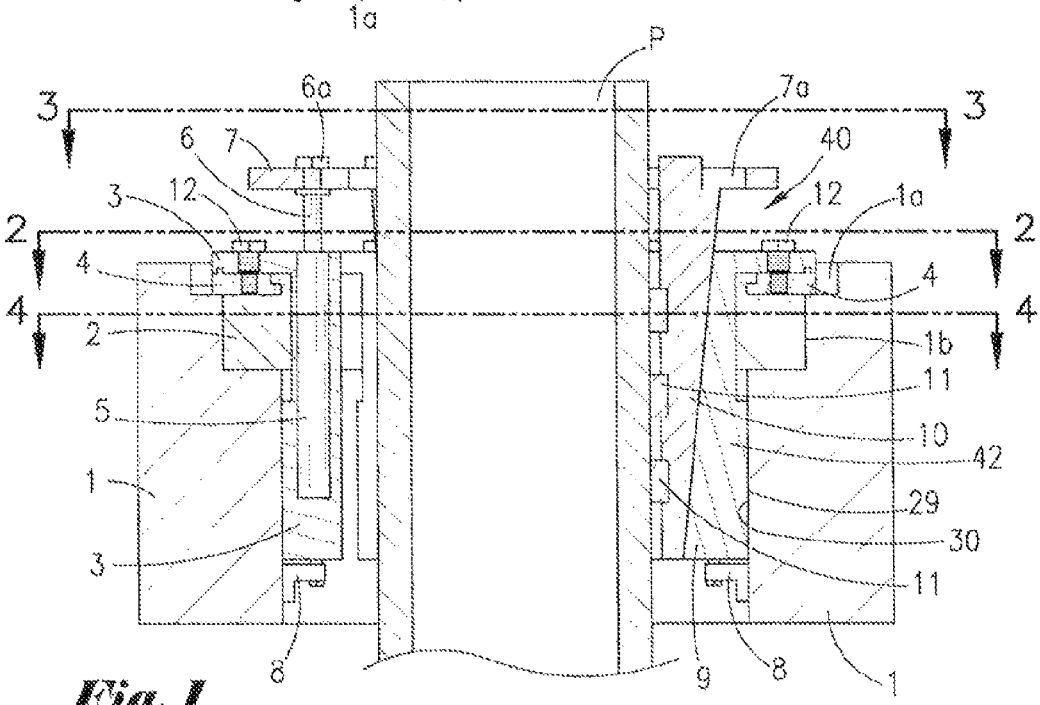
FIG. 1 is a side view, in cut away, of the preferred embodiment, with a pipe in the usual position for pipe string support.

FIG. 1 shows a side view, mostly cut away, of the preferred embodiment of the slip carrier assembly 40 inserted into the opening 1*a* of rotary table 1 gripping a length of pipe P. Rotary table 1 is abbreviated and can be considered an extraction of a cylindrical generally central portion 1*a* of a typical rotary table through which pipe P is axially inserted. Rotary table opening 1*a* has a non-circular extension with lobe recesses 1*b* that accepts the non-circular lobes 2*a* of ring 2. Each producer of rotary tables provides a non-circular recess 1*b* of his own choosing to rotationally drive the apparatus designed to fit their particular tables. Adapter ring 2, in each case is cut to fit the recess 1*b* of the target rotary table. The shape of adapter ring 2 as shown is symbolic on the outer periphery. On the top and inner periphery of ring 2, the novel features are mounted.

Each slip carrier 9 of each sub-assembly 42 is secured on ring 2 by ring sector 4, secured by cap screw 12. A slip 10 is secured, for vertical movement, on each slip carrier 9 by the equivalent of a dove tail slide arrangement. The optional security bracket 8 keeps the lower end of the slip guide 9 from being displaced when such as a stabilizer on a rising pipe string impacts the slip carrier 9 from below. Pipe gripping dies 11 are mounted on each slip 10 of each sub-assembly 42 to complete the carrier assembly 40.

Securing each slip carrier 9 of each sub-assembly 42 on the ring 2 will also maintain the position of each slip carrier 9 with respect to the rotary table opening 1*a* when the lobes 2*a* of ring 2 are accepted into the rotational drive lobe recesses 1*b* of the rotary table opening 1*a*. By securing each slip carrier 9 to the ring 2 and placing the ring 2 into the recesses 1*b* of the rotary table opening 1*a*, it can be seen that the slip carrier 9 of each sub-assembly 42 will remain in a secured and fixed position with respect to said ring 2 and said rotary table opening 1*a* during rotation of the rotary table 1.

Cylinder carrier assembly 3 is mounted on ring 2 held there by ring sector 4, secured by a cap screw 12. Linear motor 5 is attached to and transmits vertical movement to cylinder rod 6. Cylinder rod 6 is attached to synchronizer ring 7 and secured by nut 6*a*. Security bracket 8 attaches the lower end of the cylinder carrier to the rotary table 1. That prevents damage to carrier 3 when it is exposed to impact from below. The relationship between the synchronizer ring 7 and slip grooves 10*a* will be explained in relationship to FIG. 3.

As shown in FIG. 1, the slip carrier 9 of each sub-assembly 42 is inserted into and positioned within the cylindrical opening 1*a* of the rotary table 1 so that the outer face 29 of the slip carrier 9 directly abuts the interior wall 30 of the opening 1*a* in the rotary table 1. Placement of slip carrier 9 so that it will abut the interior wall 30 of opening 1*a* allows the rotary table 1 to provide for the radial restraint of the slip carriers 9. No other mechanism for radially restraining the slip carriers 9 is required during operation of the slip assembly 40 when the slip carriers are so positioned in the rotary table opening.

FIG. 2 is produced by cutting plane 2-2 of FIG. 1. Only the slips 10 and the pipe P are cut. The non-circular rotary drive features of rotary tables are represented by lobes 2*a* situated in lobe recesses 1*b*. Retaining ring arcs 4 are provided for each slip carrier and each cylinder carrier. Three slip carriers and three cylinder carriers are shown but the number of each, with geometry considered, is a matter of choice. Four slips and two cylinders could be used.

Figure 3:
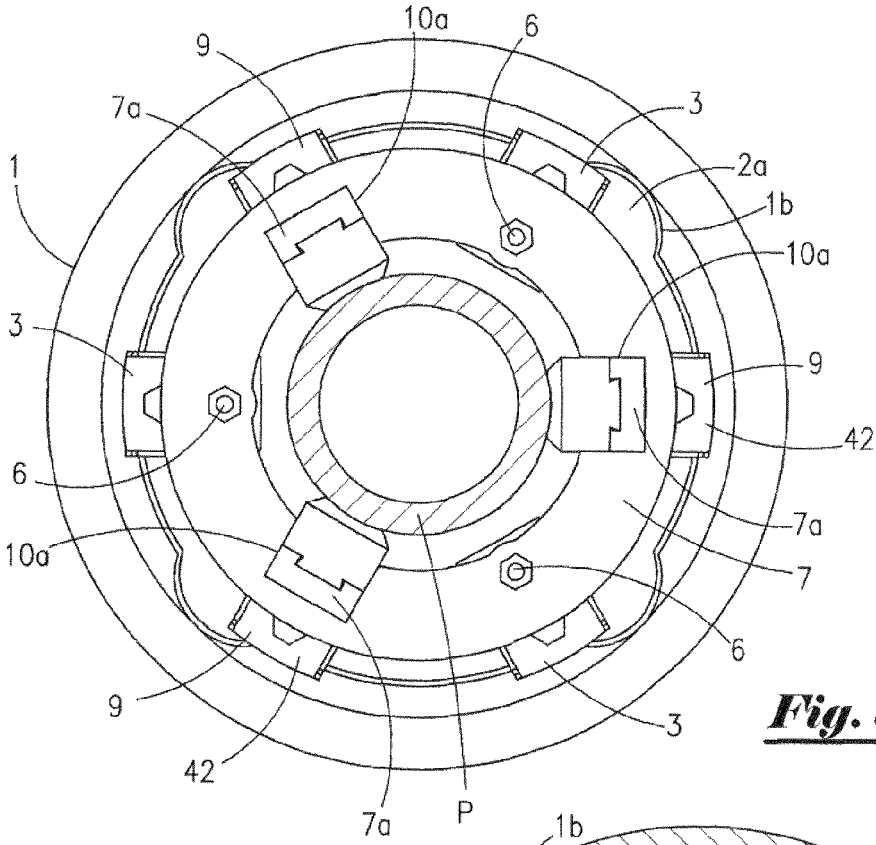
FIG. 3 is a sectional view taken along line 3-3.

FIG. 3 shows synchronizer ring 7, which is moved vertically by cylinder rods 6. The synchronizer ring 7 moves slips 10 by way of openings 7*a* in which the grooves 10*a* of the slips move radially when the slips move vertically in sympathy with the plate 7.

Figure 4:
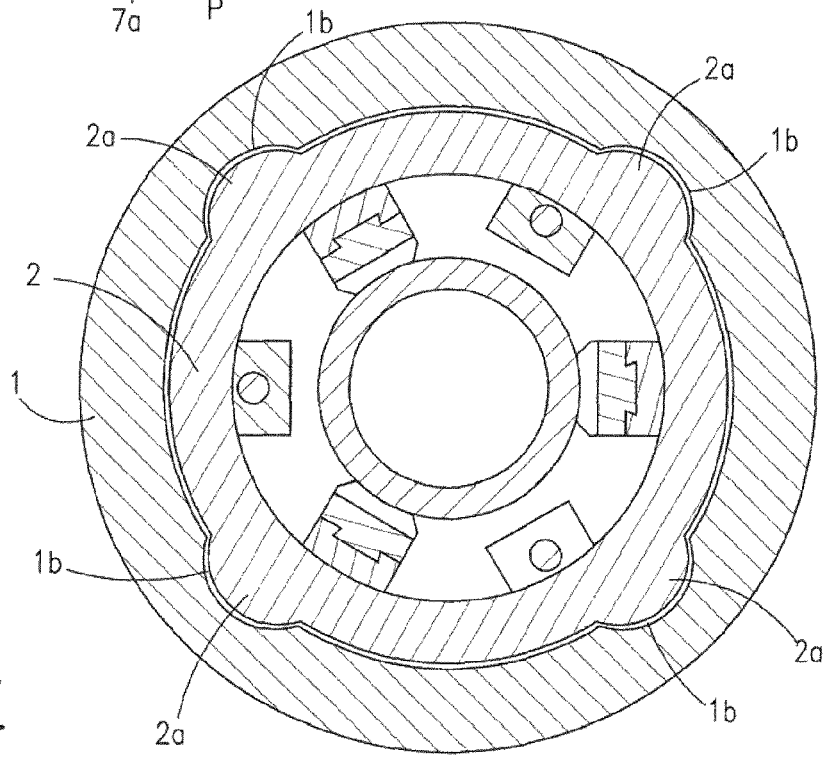
FIG. 4 is a sectional view taken along line 4-4, omitting all but the rotary table and a fitted non-circular adapter ring.

FIG. 4 is a section showing only two units, the rotary table 1 and the adapter ring 2. This illustrates the rotary drive nature of mated non-circular surfaces but it does not represent a particular shape of ring to be used. Ring 2 carries the functional components of the novel spider. The outer periphery of ring 2 will be of the configuration required to fit the rotary table to be used. In the case shown, profile 1*b* accepts mating surface 2*a*. Each supplier of rotary tables provides a preferred non-circular configuration. To change the entire spider set-up from one type rotary table to another, only ring 2 may have to be changed. The non-circular nature of most rotary tables now in use allows the design of a ring that will fit into the rotary table of any of those rotary tables. The exact shape of the ring will be adapted to also fit newly introduced rotary tables.

Figure 5:
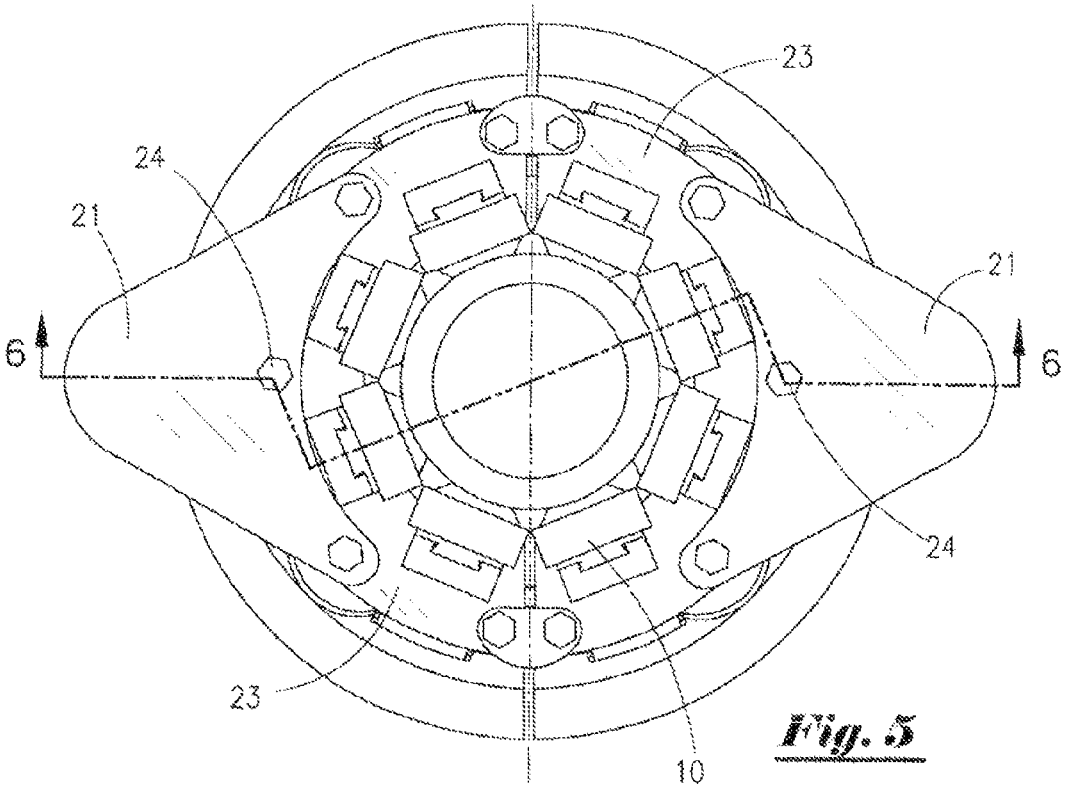
FIG. 5 is a top view of an alternate form of the invention, showing bellows type slip lifting gear.
Figure 6:
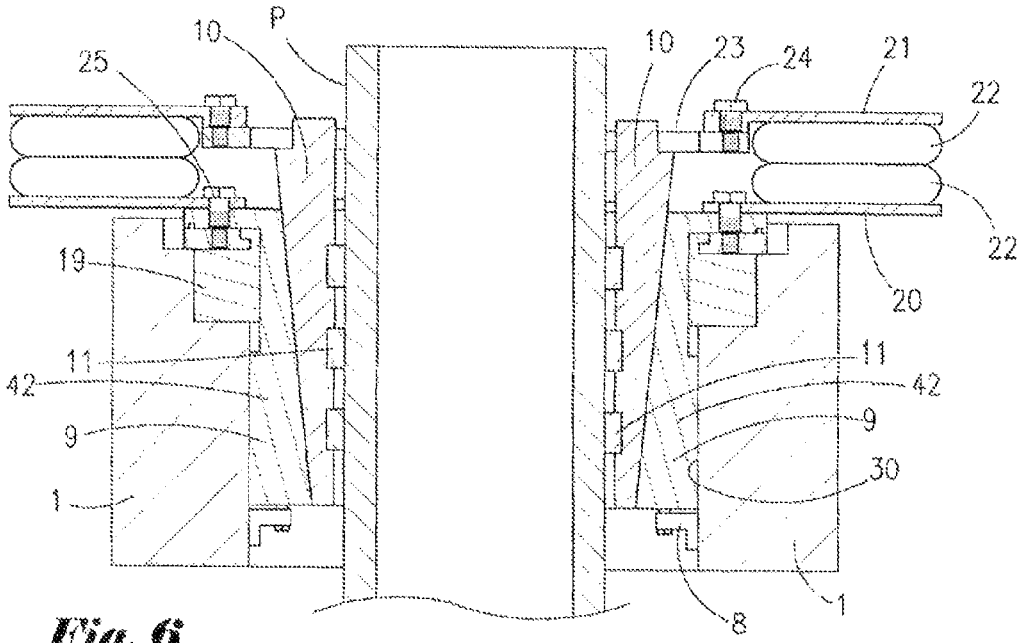
FIG. 6 is a sectional view taken along line 6-6.

FIGS. 5 and 6 show an alternate configuration of the slip manipulation gear. Slip lifting bellows are placed outside the opening in the rotary table, enabling greater loading of the opening with slips and pipe gripping dies. Plates 20 and 21 are of similar shape. Plate 20 is attached to ring 19 by cap screws 25. Plate 21 is attached to plates 23 by cap screws 24. Between plates 20 and 21, bellows 22 are situated. The bellows control and power means are not shown, can be of many possible formats, and are well established to those skilled in the related art.

When the bellows are expanded the slips 10 are lifted and pipe P is released. When the bellows are shrunk, the pipe is gripped by the dies 11 on the slips 10.

Some operators require that all elements of spiders be removable in a lateral direction from a pipe string extending through the spider. FIG. 5 is shown as a dividable spider for lateral removal from a drill string.

Figure 7:
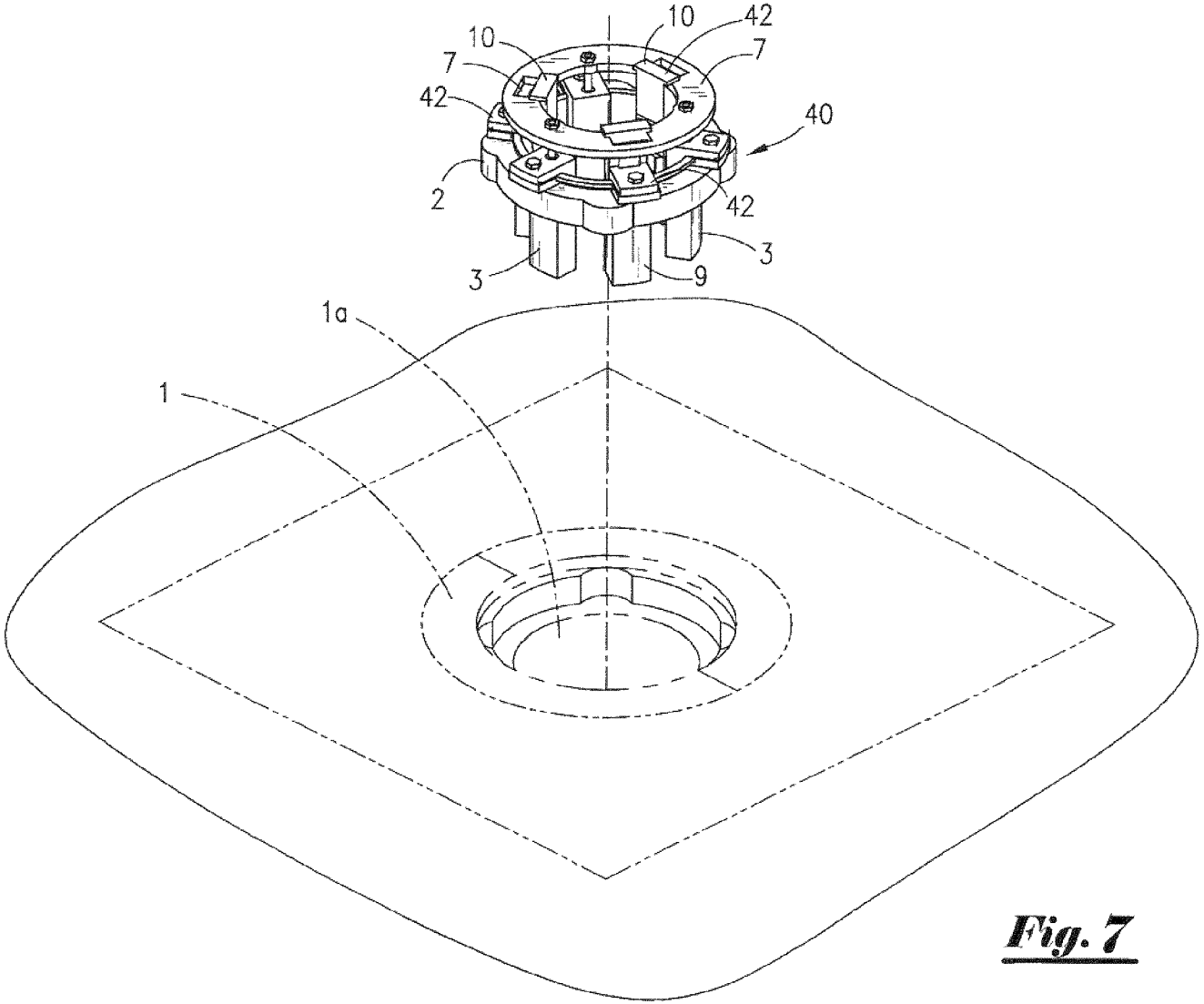
FIG. 7 is an exploded perspective view of the slip assembly shown in FIG. 1.

FIG. 7 shows an exploded perspective view of the fully assembled slip assembly 40 and rotary table 1 shown in FIG. 1. FIG. 7 illustrates the slip assembly 40 prior to its insertion in the opening 1*a* of the rotary table 1. As shown in FIG. 7, the slip assembly 40 is comprised of a plurality of sub-assemblies 42. Each sub-assembly 42 has a plurality of slip carriers 9 suspended and secured on ring 2 by ring sector 4. A slip 10 is secured, for vertical movement, on each slip carrier 9 by the equivalent of a dove tail slide arrangement. A plurality of cylinder carrier assemblies 3 are mounted on ring 2. The cylinder rod of each cylinder carrier assembly is attached to synchronizer ring 7 which supports the slips 10 for simultaneous vertical movement of the slips 10 on the slip carriers 9 in response to the movement of the cylinder rods.

Figure 9:
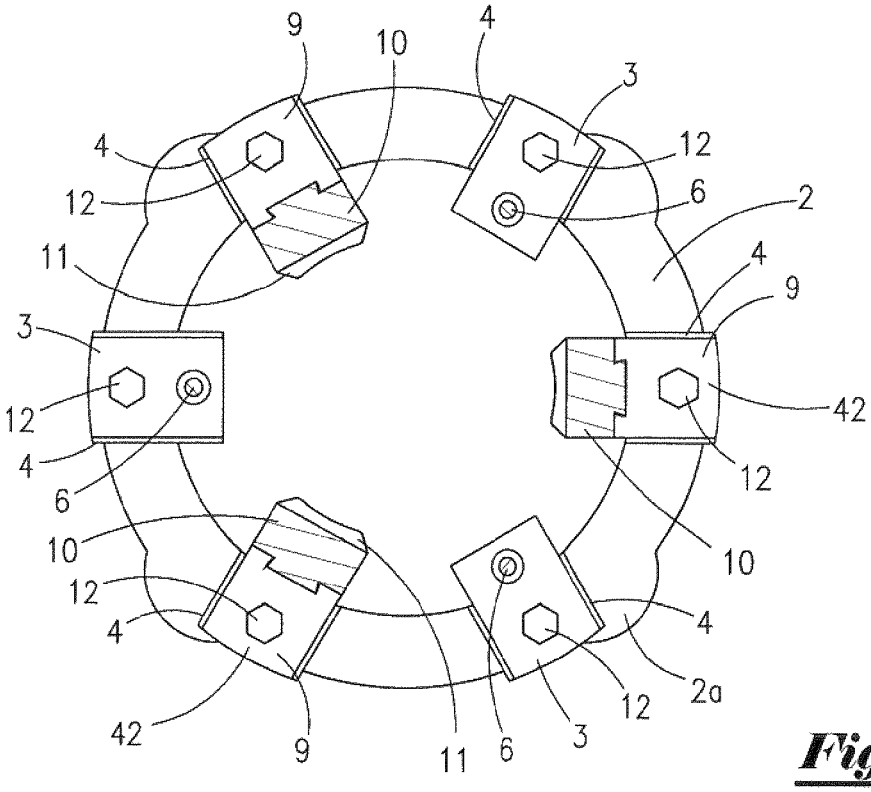
FIG. 9 is a top cross-sectional view of the slip assembly shown in FIG. 8 taken along line 9-9.
Figure 8:
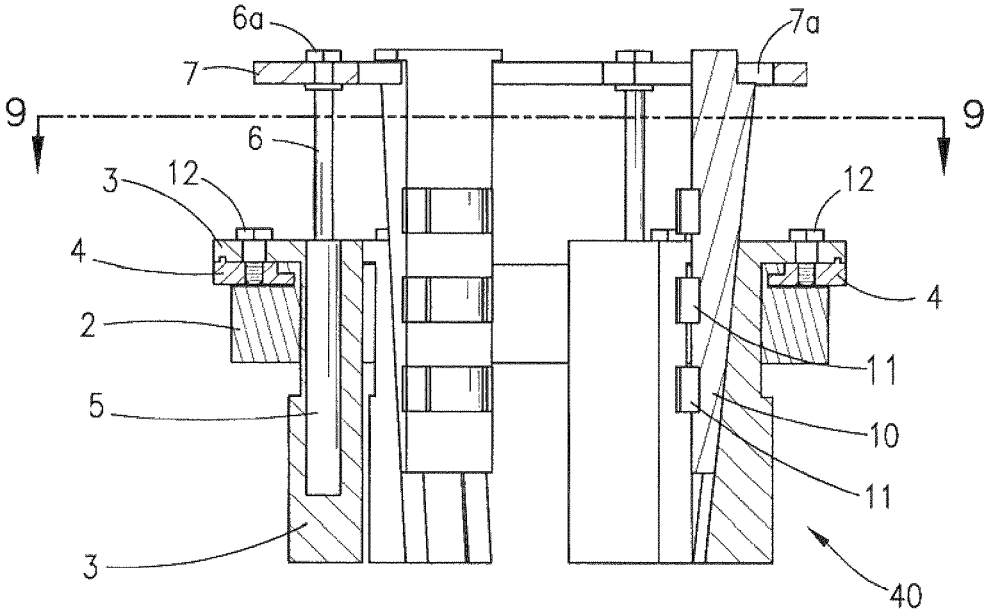
FIG. 8 is a cross-sectional view of the slip assembly.
Figure 10:
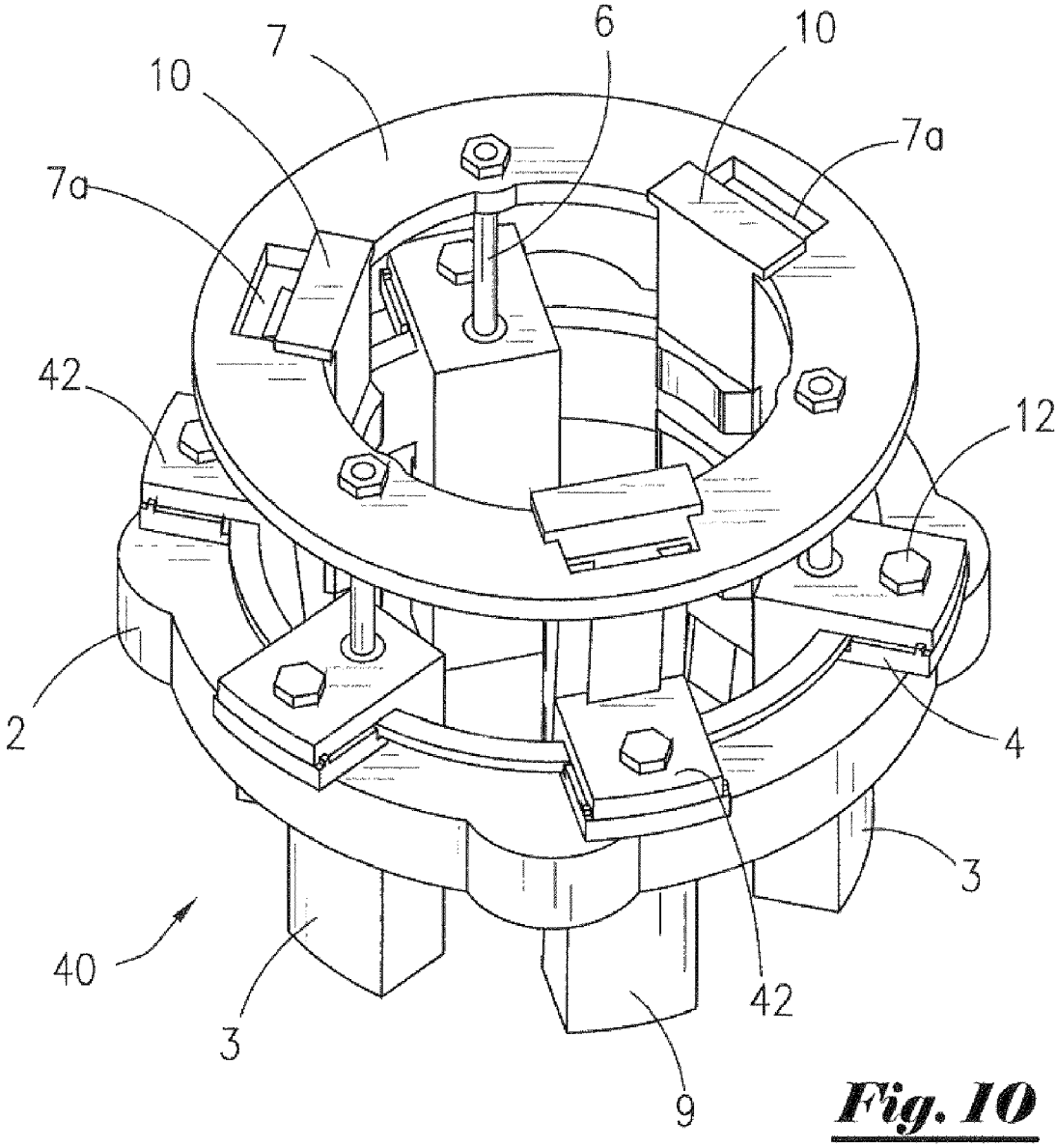
FIG. 10 is a perspective view of the slip assembly shown in FIGS. 8 and 9.

FIGS. 8 and 9 are cross-sectional and top views, respectively, of the slip carrier assembly 40 shown in FIG. 1 and FIG. 7. FIG. 10 is a perspective view of the assembled slip carrier assembly 40 and its components. These views show the slip carrier assembly 40 prior to its insertion into the rotary table.

As shown in FIGS. 8, 9 and 10, slip carrier 9 of the sub-assemblies 42 are peripherally distributed on ring 2 and secured by ring sector 4 and cap screw 12. Each slip carrier 9 has a slip 10 secured, for vertical movement, by the equivalent of a dove tail slide arrangements. Pipe gripping dies 11 are mounted on each slip 10. At least one cylinder carrier assembly 3 is mounted on ring 2 and held there by ring sector 4, secured by a cap screw 12.

The cylinder assemblies 3 include a linear motor 5 that transmits vertical movement to cylinder rod 6. Cylinder rod 6 is attached to synchronizer ring 7 and secured by nut 6*a*. The synchronizer ring 7 is moved vertically by cylinder rods 6. Vertical movement of the synchronizer ring 7 moves slips 10 by way of openings 7*a* in which the grooves 10*a* of the slips move radially when the slips move vertically in sympathy with the plate 7. The number of cylinder assemblies 3 and slip assemblies 42 is a matter of choice.

In an embodiment, a distance between each slip carrier (9) and an adjacent slip carrier is greater than a width (27) of the slip carrier. This can be seen in FIG. 2. In another embodiment, the distance between the outer face (29) of each slip carrier (9) and an outer face of an adjacent slip carrier is greater than a width (27) of the slip carrier. This can be seen in FIGS. 1 and 2.

From the foregoing, it will be seen that this invention is one well adapted to attain all of the ends and objects hereinabove set forth, together with other advantages which are obvious and which are inherent to the invention.

It will be understood that certain features and sub-combinations are of utility and may be employed without reference to other features and sub-combinations. This is contemplated by and is within the scope of the claims.

As many possible embodiments may be made of the apparatus of this invention without departing from the scope thereof, it is to be understood that all matter herein set forth or shown in the accompanying drawings is to be interpreted as illustrative and not in a limiting sense.

I claim:

1. A slip carrier assembly for use in a rotary table of a drilling rig, said rotary table having rotational drive recesses and an opening for insertion of a length of pipe, the slip carrier assembly comprising:

a) a plurality of slip carriers with a mounting structure for supporting said plurality of slip carriers, said mounting structure comprised of a ring configured to fit said rotational drive recesses of said rotary table, each of said slip carriers secured to said ring within said opening of said rotary table of said drilling rig, each of said slip carriers having a corresponding slip and a slipway for support and retention of said corresponding slip for relative vertical movement of said corresponding slip, and whereby each said slip carrier of said plurality of slip carriers is radially restrained directly by said rotary table opening and wherein said slip carriers remain in a secured position with respect to said ring and said rotary table opening;

b) each said corresponding slip arranged for mounting on said corresponding slip carrier of said plurality of slip carriers and having a mating surface for attachment and movement on said corresponding slip carrier; and c) at least one pipe gripping die arranged for mounting on each said slip, said die having gripping surfaces for gripping the surface of said pipe.

2. A slip carrier assembly according to claim 1 wherein each said slipway of each said slip carrier comprises capture surfaces to retain said slip on said slip carrier.

3. A slip carrier assembly according to claim 2 wherein said slip mating surface of each said slip is arranged to engage said capture surface to retain said slip on said slip carrier and permit said vertical movement relative to said slip carrier.

4. In the combination of a slip carrier and slip manipulation assembly and a rotary table of a drilling rig, said rotary table having recesses to rotational drive associated equipment and an opening for insertion of a length of pipe, an improved slip carrier and manipulation assembly comprising:

a) a plurality of slip carriers with a mounting structure configured for placement of said slip carriers within an opening of a rotary table of a drilling rig, said rotary table having recesses to rotational drive associated equipment and an opening for insertion of a length of a pipe, said mounting structure comprised of a ring configured to fit said rotational drive recesses of said rotary table, each of said slip carriers secured to said ring, each of said slip carriers having a slipway for support and retention of a corresponding slip, for relative vertical movement of said corresponding slip, wherein radial restraint of each of said slip carriers will be provided directly by said rotary table opening when said plurality of slip carriers is inserted into said opening of said rotary table and wherein each said slip carrier remains in a secured position with respect to said ring and thereby said rotary table opening;

b) each said slip arranged for mounting on its said corresponding slip carrier and having a mating surface for attachment and movement on said slip carrier;

c) at least one pipe gripping die arranged for mounting on each said slip, said die having gripping surfaces for gripping the surface of pipe; and d) a linear, fluid powered, motor with structure for attachment to said mounting structure, said linear, fluid powered, motor having structure for transmitting vertical movement to each said slip.

5. The slip carrier and slip manipulation assembly according to claim 4 wherein said slipway on each said slip carrier comprises capture surfaces to retain said corresponding slip on said slip carrier.

6. The slip carrier and slip manipulation assembly according to claim 5 wherein said slip mating surface of each said slip is arranged to engage said capture surface to retain said slip on its said slip carrier and permit said vertical movement relative to said slip carrier.

7. A slip carrier assembly for use in a rotary table of a drilling rig, said rotary table having rotational drive recesses and an opening for axial insertion of a length of pipe, said rotary table opening defined by an interior wall, the slip carrier assembly comprising:

a) a plurality of slip carriers, each said slip carrier being comprised of a vertically oriented plate, each said slip carrier having a slipway for support and retention of a corresponding slip, for relative vertical movement of said corresponding slip, each said slip carrier being spatially separated from an adjacent said slip carrier and supported on a ring, said ring configured to fit said rotational drive recesses of said rotary table, each of said slip carriers secured to said ring, each of said slip carriers adapted for peripheral distribution within said rotary table opening of said drilling rig, around said interior wall of said opening and wherein each said slip carrier remains in a secured position with respect to said ring and thereby said rotary table opening;

b) each said slip carrier having an outer face configured for contact with said interior wall of said rotary table opening;

c) each said slip arranged for mounting on its said corresponding slip carrier and having a mating surface for attachment and movement on said slipway of said slip carrier; and d) at least one pipe gripping die arranged for mounting on each said slip, each said die having gripping surfaces for gripping the surface of said length of pipe.

8. A slip carrier assembly according to claim 7 wherein radial restraint of said slip carrier assembly is provided by said interior wall of said rotary table upon insertion of said slip carriers into said opening of said rotary table.

9. A slip carrier assembly according to claim 7 wherein radial restraint of each of said slip carriers is provided by contact with said interior wall of said rotary table opening.

10. A slip carrier assembly according to claim 7 wherein a distance between each said slip carrier and an adjacent said slip carrier is greater than a width of said slip carrier.

11. A slip carrier assembly according to claim 7 wherein a distance between said outer face of each said slip carrier and an outer face of an adjacent said slip carrier is greater than a width of said slip carrier.

12. A slip carrier assembly according to claim 7 wherein each said slipway of each said slip carrier comprises capture surfaces to retain said slip on said slip carrier.

13. A slip carrier assembly according to claim 12 wherein said slip mating surface of each said slip is arranged to engage said capture surface of each said slipway to retain said slip on said slip carrier and permit said vertical movement relative to said slip carrier.

14. A slip carrier assembly and slip manipulation assembly for use in a rotary table of a drilling rig, said rotary table having rotational drive recesses and an opening for axial insertion of a length of pipe, the slip carrier assembly comprising:

a) a plurality of slip carriers, said slip carriers being peripherally distributed on mounting structure, said mounting structure comprised of a ring configured to fit said rotational drive recesses of said rotary table, each of said slip carriers secured to said ring, each said slip carrier being comprised of a vertically oriented plate having a corresponding slip, each said slip carrier having a slipway for support and retention of said corresponding slip, for relative vertical movement of said slip, each said slip carrier being spatially separated from an adjacent said slip carrier, said plurality of slip carriers configured for insertion into said opening of said rotary table of said drilling rig;

b) each said slip carrier having an outer face configured for contact with said rotary table opening of said drilling rig;

c) said corresponding slip arranged for mounting on said slip carrier and having a mating surface for attachment and movement on said slipway of said slip carrier;

d) at least one pipe gripping die arranged for mounting on each said slip, said die having gripping surfaces for gripping the surface of said length of pipe; and e) a linear, fluid powered, motor with structure for attachment to said rotary table, said linear, fluid powered, motor having structure for transmitting vertical movement to each said slip.

15. A slip carrier assembly according to claim 14 wherein said slip carrier assembly is radially restrained by said rotary table opening.

16. A slip carrier assembly according to claim 15 wherein said slip carrier assembly remains in a secured position with respect to said ring and said rotary table opening.

17. A slip carrier assembly according to claim 16 wherein a distance between each said slip carrier and an adjacent said slip carrier is greater than a width of said slip carrier.

18. A slip carrier assembly according to claim 17 wherein a distance between said outer face of each said slip carrier and an outer face of an adjacent said slip carrier is greater than a width of said slip carrier.

19. A slip carrier assembly according to claim 18 wherein each said slipway of each said slip carrier comprises capture surfaces to retain said corresponding slip on said slip carrier.

20. A slip carrier assembly according to claim 19 wherein said slip mating surface of each said slip is arranged to engage said capture surface of each said slipway of its corresponding slip carrier to retain said slip on said slip carrier and permit said vertical movement relative to said slip carrier.

21. In the combination of a slip carrier and slip manipulation assembly and a rotary table of a drilling rig, said rotary table having a rotational drive recess and an opening defined by an interior wall for axial insertion of a length of pipe, an improved slip carrier and manipulation assembly comprising:

a) a plurality of slip carriers distributed peripherally around mounting structure, said mounting structure comprised of a ring configured to fit said rotational drive recess of said rotary table, each of said slip carriers secured to said ring, each said slip carrier being comprised of a vertically oriented plate, each said slip carrier having a slipway for support and retention of a slip, for relative vertical movement of said slip, each said slip carrier being spatially separated from an adjacent said slip carrier, said slip carriers adapted for insertion into said opening of said rotary table of said drilling rig;

b) each said slip carrier having an outer face for contact with the interior peripheral surface of said rotary table opening whereby each said slip carrier will be radially restrained directly by said rotary table opening upon insertion of said slip carriers into said opening of said rotary table of said drilling rig and wherein each said slip carrier remains in a secured position with respect to said ring and thereby said rotary table opening;

c) said slip arranged for mounting on said slip carrier and having a mating surface to secure said slip for vertical movement on said slipway of said slip carrier; and d) at least one pipe gripping die arranged for mounting on said slip, said die having gripping surfaces for gripping the surface of said length of pipe.

22. A slip carrier assembly according to claim 21 wherein radial restraint of said slip carriers is provided substantially by said rotary table.

23. A slip carrier assembly according to claim 21 wherein a distance between each said slip carrier and an adjacent said slip carrier is greater than a width of said slip carrier.

24. A slip carrier assembly according to claim 21 wherein a distance between said outer face of each said slip carrier and an outer face of an adjacent said slip carrier is greater than a width of said slip carrier.

25. A slip carrier assembly according to claim 21 wherein each said slipway of each said slip carrier comprises capture surfaces to retain said slip on said slip carrier.

26. A slip carrier assembly according to claim 25 wherein said slip mating surface of said slip is arranged to engage said capture surface of each said slipway to retain said slip on said slip carrier and permit said vertical movement relative to said slip carrier.

27. A slip carrier and slip manipulation assembly for use in combination with a rotary table of a drilling rig, said rotary table having rotational drive recesses and an opening defined by an interior wall for axial insertion of a length of pipe, the slip carrier and slip manipulation assembly comprising:

a) a plurality of slip carriers mounted to and peripherally distributed around a mounting ring, said mounting ring configured to fit said rotational drive recesses of said rotary table, each of said slip carriers secured to said ring, each said slip carrier being comprised of a vertically oriented plate, each said slip carrier having a slipway for support and retention of a slip, for relative vertical movement of said slip along said slip carrier, each said slip carrier being spatially separated from an adjacent said slip carrier, each said slip carrier adapted for insertion into said opening of said rotary table of said drilling rig whereby said slips are radially restrained directly by the interior wall of said rotary table opening and wherein each said slip carrier remains in a secured position with respect to said mounting ring and said rotary table opening;

b) each said slip carrier having an outer face configured for contact with said rotary table opening;

c) said slip arranged for mounting on said slip carrier and having a mating surface for attachment and movement on said slipway of said slip carrier;

d) at least one pipe gripping die arranged for mounting on said slip, said die having gripping surfaces for gripping the surface of said length of pipe; and e) a linear, fluid powered, motor with structure for attachment to said mounting ring, said linear, fluid powered, motor having structure for transmitting vertical movement to each said slip of said plurality of slip carriers.

28. A slip carrier assembly according to claim 27 wherein a distance between each said slip carrier and an adjacent said slip carrier is greater than a width of said slip carrier.

29. A slip carrier assembly according to claim 27 wherein a distance between said outer face of each said slip carrier and an outer face of an adjacent said slip carrier is greater than a width of said slip carrier.

30. A slip carrier assembly according to claim 27 wherein each said slipway of each said slip carrier comprises capture surfaces to retain said slip on said slip carrier.

31. A slip carrier assembly according to claim 30 wherein said slip mating surface of said slip is arranged to engage said capture surface of each said slipway to retain said slip on said slip carrier and permit said vertical movement relative to said slip carrier.

* * * * *